US007462275B2

(12) United States Patent
Das et al.

(10) Patent No.: US 7,462,275 B2
(45) Date of Patent: Dec. 9, 2008

(54) PROCESS FOR CONVERSION OF HYDROCARBONS TO SATURATED LPG AND HIGH OCTANE GASOLINE

(75) Inventors: Asit Kumar Das, Faridabad (IN); Debasis Bhattacharyya, Faridabad (IN); Gadari Saidulu, Faridabad (IN); Satayen Kumar Das, Faridabad (IN); Bandaru Venkata Hari P. Gupta, Faridabad (IN); Ramakrishnan Ramanarayanan, Faridabad (IN); Latoor Lal Saroya, Faridabad (IN); Konduri Lakshminarayana, Faridabad (IN); Marri Rama Rao, Faridabad (IN); Vinod Ramchandra Upadhyay, Faridabad (IN); Sukumar Mandal, Faridabad (IN); Deepa Meghavathu, Faridabad (IN); Arumugam Velayutham Karthikeyani, Faridabad (IN); Wadharwa Ram Kalsi, Faridabad (IN); Arvind Pratap Singh, Faridabad (IN); Veena Bansal, Faridabad (IN); Ashok Kumar Tiwari, Faridabad (IN); Venkatachalam Krishnan, Faridabad (IN); Satish Makhija, Faridabad (IN); Sobhan Ghosh, Faridabad (IN); Niranjan Raghunath Raje, Faridabad (IN)

(73) Assignee: Indian Oil Corporation Limited (IN)

( * ) Notice: Subject to any disclaimer, the term of this patent is extended or adjusted under 35 U.S.C. 154(b) by 225 days.

(21) Appl. No.: 10/894,341

(22) Filed: Jul. 20, 2004

(65) Prior Publication Data

US 2006/0016725 A1 Jan. 26, 2006

(51) Int. Cl.
*C10G 67/00* (2006.01)

(52) U.S. Cl. ..... 208/97; 208/74; 208/75; 208/76; 208/77; 208/78; 208/113; 208/157

(58) Field of Classification Search ..... 208/113, 208/97, 74, 75, 76, 77, 78, 157
See application file for complete search history.

(56) References Cited

U.S. PATENT DOCUMENTS

| | | | | |
|---|---|---|---|---|
| 4,350,614 | A * | 9/1982 | Schwartz | 502/74 |
| 4,863,585 | A * | 9/1989 | Herbst et al. | 208/74 |
| 5,171,921 | A * | 12/1992 | Gaffney et al. | 585/653 |
| 6,222,087 | B1 * | 4/2001 | Johnson et al. | 585/651 |

OTHER PUBLICATIONS

Anots, George J. and Abdullah M. Aitani. "Catalytic Naptha Reforming", 2004, Marcel Dekker, Inc, New York, Basel, pp. iii-x and 1-11.

* cited by examiner

*Primary Examiner*—Glenn Caldarola
*Assistant Examiner*—Prem C. Singh
(74) *Attorney, Agent, or Firm*—Lowe Hauptman Ham & Berner, LLP

(57) ABSTRACT

The present invention relates to a process for the conversion of hydrocarbon streams with 95% true boiling point less than 400° C. to very high yield of liquefied petroleum gas in the range of 45-65 wt % of feed and high octane gasoline, the said process comprises catalytic cracking of the hydrocarbons using a solid fluidizable catalyst comprising a medium pore crystalline alumino-silicates with or without Y-zeolite, non crystalline acidic materials or combinations thereof in a fluidized dense bed reactor operating at a temperature range of 400 to 550° C., pressure range of 2 to 20 kg/cm$^2$ (g) and weight hourly space velocity in range of 0.1 to 20 hour$^{-1}$, wherein the said dense bed reactor is in flow communication to a catalyst stripper and a regenerator for continuous regeneration of the coked catalyst in presence of air and or oxygen containing gases, the catalyst being continuously circulated between the reactor-regenerator system.

19 Claims, No Drawings

PROCESS FOR CONVERSION OF HYDROCARBONS TO SATURATED LPG AND HIGH OCTANE GASOLINE

FIELD OF THE INVENTION

The present invention relates to a process for conversion of hydrocarbon streams with 95% true boiling point less than 400° C., and preferably below 250° C. to high yield of LPG (olefins<20 wt % of LPG) and high octane gasoline with significantly lower olefins (<2 wt %) and sulfur content using fluidizable solid acidic catalyst in a continuously circulating fluidized dense bed reactor.

DESCRIPTION OF THE PRIOR ART

In recent years, significant attention is given on improvement of quality of fuels, both gasoline and diesel, to meet the stringent specifications. One of the requirements for improving the fuel quality is to reduce the olefins content, which are photo-chemically reactive and a major factor in the smog problem. Olefins are also undesirable due to higher gum-forming tendency and also relatively lower motor octane number (MON). Environmental regulations have also restricted the use of streams with higher sulfur and aromatics (particularly benzene) as fuel. Due to the above factors along with the lower vapor pressure requirements of gasoline, some of the streams such as visbreaker/coker naphtha, benzene rich light naphtha from reformer feed, high sulfur olefinic FCC gasoline, etc. no longer qualify for blending into gasoline pool. At the same time, demand of straight run naphtha is in declining trend due to its substitution by natural gas in fertilizer and power sectors owing to obvious reasons. Hence, utilization of the above streams is a problem to the refiners worldwide, which will further aggravate in days to come.

On the other hand, the demand of LPG is in increasing trend in countries like India and other countries of Asia e.g., China, Philippines, etc. The prime application is as domestic cooking gas. LPG (rich in $C_3$ & $C_4$ paraffins) is emerging as a popular automobile fuel due to its several advantages. The total number of vehicles run on LPG the world over is estimated at four million, which is likely to increase further in coming days. As a result, the demand of saturated LPG for use as auto-grade fuel will also increase. In such situation, a process for conversion of low value naphtha streams to products like LPG is going to be highly attractive to the refiners.

Conventionally, naphtha streams are thermally cracked in steam crackers at high temperature (above 800° C.) to produce light olefins for use as petrochemical feedstocks. However, since the cracking process is thermal in nature, the yield of dry gas ($H_2$, $C_1$ & $C_2$) including ethylene (50 wt % of feed) is much higher as compared to LPG (25 wt % of feed). Although steam cracking is widely used, the process is energy intensive and not very selective towards the LPG, particularly saturated LPG for automotive application.

Catalytic cracking is an alternate route for selective conversion of naphtha to light olefins. In this regard, conventional fluid catalytic cracking (FCC) units can be adapted to convert naphtha to light olefins either through injection of naphtha in the same riser along with main feed, normally vacuum gas oil (U.S. Pat. Nos. 6,538,169, 6,238,548 and 5,389,232) or through incorporation of a second riser (U.S. Pat. No. 5,372,704 and 4,918,256). Most of these references deal with olefin rich naphtha streams e.g. visbreaker, coker and FCC naphtha and does not include the straight run naphtha.

Hsing et al discloses a process in U.S. Pat. No. 5,637,207 for converting light paraffin naphtha ($C_7$—$C_{10}$) to light olefins ($C_2$—$C_5$) and naphtha of enhanced octane through its use as a lift fluid along with an inert gas at bottom of a conventional FCC riser. The conversion of naphtha ($C_5$—) was reported to be 52.84 vol % of naphtha feed with 2 wt % ZSM-5 additive in Y-zeolite based catalyst inventory.

The gasoline produced in the above methods has high octane with high sulfur and high olefin content. Under typical FCC conditions, the naphtha conversion is not very high. Also, the amount of naphtha processed is only fraction of the total FCC feed (<5 wt %) due to the limitations in hardware design and catalyst activity dilution.

There are some processes disclosed exclusively for selective conversion of naphtha to lower olefins ($C_2$—$C_4$) in fluid bed riser, dense bed reactor or fixed bed reactor using ZSM-5 based catalyst. U.S. Pat. Nos. 6,548,725, 5,171,921 and 6,222,087 propose catalytic cracking processes for conversion of naphtha to light olefins on catalysts comprising phosphate doped ZSM-5 zeolite with or without promoter metal in a short residence time riser or dense bed reactor. Yield of $C_3$ plus $C_4$ using catalytically cracked light naphtha as feed was reported to be about 36 wt % of feed in U.S. Pat. No. 6,222,087.

U.S. Pat. No. 5,167,795 describes a process for the conversion of hydrocarbon feedstocks consisting of $C_4$—$C_7$ paraffins, naphtha and light gas oils by catalytic cracking in riser and quenching with similar activity catalyst to produce light olefins and aromatics, especially benzene. The yield of LPG was reported to be 46.7 wt % using FCC gasoline as feed. However, the dry gas produced was also high (15.4 wt % of feed).

U.S. Pat. Nos. 6,455,750, 6,153,089 and 6,602,403 mention processes for the upgradation of catalytically or thermally cracked naphtha to light olefins ($C_2$—$C_4$) and aromatics rich and/or high octane gasoline using ZSM-5 based and large pore zeolite catalyst. U.S. Pat. No. 6,153,089 by Das et al reports a process for producing 30-60 wt % of $C_3$ and $C_4$ hydrocarbons comprising olefins more than 50% at very high reactor temperature (above 570° C.) and pressure similar to that of conventional FCC (0.5-2.5 atm (g)). One of the products of these naphtha conversion processes is gasoline with higher aromatics and hence higher octane no. Under the present and the emerging scenario, such gasoline needs further pretreatment for reduction of sulfur and olefins before blending into gasoline pool.

Some conventional processes attempt to reduce sulfur and olefins concentration in naphtha by employing hydroprocessing stage subsequent to catalytic cracking. Such hydroprocessing results in reduction of octane number. U.S. Pat. No. 6,315,890 discloses a two-step process for converting high octane naphtha having higher olefins and sulfur like FCC naphtha to a gasoline having a reduced concentration of sulfur without substantial reduction of octane number wherein the first step comprises cracking an olefinic naphtha and the second step comprises a mild hydroprocessing. However, such processes cannot upgrade the low octane coker and visbreaker naphtha.

In similar way, U.S. Pat. No. 3,758,628 by Strckland et al discloses a two step process for converting low octane paraffinic naphtha to high octane gasoline. First step comprises hydrocracking of paraffinic naphtha and the second step comprises a catalytic cracking. The UOP hydrocracking process converts naphtha to high yield of saturated LPG with production of low sulfur and zero olefin content gasoline. Since the octane number of gasoline is substantially lower, it cannot be blended directly into a gasoline pool. Also, such processes require higher capital investment and higher operating cost due to requirement of external hydrogen and overall it becomes costlier to handle coker and visbreaker naphtha.

To summarize, in the above processes via catalytic routes, maximum LPG yield is reported to be 60 wt % using highly olefinic naphtha feedstock. These processes also produce very high dry gas yield. We could not find any process for catalytic conversion of naphtha towards maximum production of highly saturated LPG along with a gasoline of high octane. Therefore, there remains a need for a new process for production of saturated LPG together with a high octane gasoline with substantially lower olefins and sulfur which can be directly incorporated in refinery gasoline pool without additional treatment using low value naphtha streams as feedstocks irrespective of their sources.

OBJECTS OF THE INVENTION

In light of the above background, it is the main object of the invention to derive a process wherein naphtha, light gas oil irrespective of their source, in particular, straight run naphtha as well as olefinic naphtha e.g., visbreaker naphtha, coker naphtha, FCC gasoline in an operating refinery can be converted to value added products such as LPG and gasoline.

It is another objective of the process to have required reactions of substantially cracking along with reforming, alkylation, hydrogen transfer and Isomerization to produce high yield LPG comprising predominantly $C_3$ and $C_4$ alkanes for its use as automobile grade fuel and or other application such as cooking gas without using external hydrogen supply.

It is yet another objective of the present invention to produce a gasoline product with substantially higher octane but lower quantity of olefins and sulfur without desulfurizing the feed before handling.

It is still another objective of the invention to provide a single process wherein saturated LPG and high octane gasoline can be produced in a single step catalytic process with adequate flexibility to change the ratio of LPG to gasoline make, substantially at ease.

SUMMARY OF THE INVENTION

In distinction to the prior art processes, the present invention provides a process for conversion of hydrocarbon streams with 95% true boiling point less than 400° C., and preferably below 250° C. using a solid fluidizable catalyst comprising a medium pore crystalline alumino-silicates with or without Y-zeolite, non crystalline acidic materials or combinations thereof in a continuously circulating dense fluidized bed reactor to produce high yield of LPG (45-65 wt % of feed) and high-octane gasoline (RON>92). The LPG produced in the process of the invention is highly saturated with olefins content less than 20 wt %. The product gasoline is rich in aromatics having ROM more than 92 with substantially lower olefin content, less than 2 wt %. The catalyst system and the process conditions of the present invention also favors very high degree of desulfurization without use of external hydrogen resulting less than 5 wt % of feed sulfur as sulfur in gasoline.

In accordance with the invention, the hydrocarbon feed is contacted with a hot regenerated catalyst in a high velocity riser, which is connected to a dense fluidized bed reactor for simultaneous cracking along with reforming, alkylation, hydrogen transfer and Isomerization of the feed hydrocarbon under the operating conditions of temperature range of 400 to 550° C., pressure range of 2 to 20 kg/cm$^2$ (g) and WHSV range of 0.1 to 20 hour$^{-1}$. Spent catalyst is transported into a catalyst stripper from the reactor where steam stripping is performed to remove entrained hydrocarbons from the spent solid catalyst.

Regeneration of the spent catalyst is performed in a fluidized bed regenerator in the presence of air and or oxygen containing gases at a temperature ranging from 600° C. to 700° C. to burn off the coke and provide a regenerated catalyst with coke content of less than 0.05 wt % at the bottom of the riser.

DETAILED DESCRIPTION OF THE INVENTION

Accordingly, the present invention provides a process for catalytic conversion of hydrocarbon feed streams having 95% true boiling point less than about 400° C. to LPG comprising C3 and C4 hydrocarbons in the range of 30 to 65 wt % of the fresh hydrocarbon in high yield and gasoline having octane number greater than about 90, said process comprising:

(a) contacting the hydrocarbon feed stream with hot activated micro-spherical solid fluidizable catalyst composition comprising medium pore crystalline alumino-silicates and optionally "Y" type zeolite and non crystalline acidic materials in a riser;

(b) transporting the mixture of hydrocarbon feed stream and the catalyst into a dense bed reactor operating with weight hourly space velocity (WHSV) in the range of 0.1 to 20 hr$^{-1}$, hydrocarbon feed stream residence time being greater than 5 seconds and catalyst residence time being greater than or equal to 60 seconds for cracking the hydrocarbon feed stream at a temperature in the range of 400 to 550° C. and pressure in the range of 2 to 20 kg/cm$^2$ (g) thereby obtaining LPG comprising C3 and C4 hydrocarbons with olefin content less than 20% (wt/wt) and propane to butane ratio of more than 2 (wt/wt) and having propane in the range of 50 to 70% by wt.

In an embodiment of the present application, the micro-spherical solid fluidizable catalyst comprises 5 to 40 wt % of medium pore crystalline alumino-silicates, 0 to 10 wt % of "Y" type zeolites, 0 to 5 wt % of non crystalline acidic materials and remaining being non-acidic components and binder.

In another embodiment of the present application, the medium pore crystalline alumino-silicates used comprises shape selective pentasil zeolite such as ZSM-5, ZSM-11 with pore diameter in the range of 0.5 to 0.6 nanometers.

In yet another embodiment of the present application, the micro-spherical solid fluidizable catalyst comprises 10 to 30 wt % of the shape selective pentasil zeolite.

In still another embodiment of the present application, the "Y" type zeolite used is selected from ReY or USY zeolite.

In one more embodiment of the present application, the micro-spherical solid fluidizable catalyst composition comprises 0 to 5 wt % of ReY or USY zeolite.

In one another embodiment of the present application, the non-crystalline acidic material is selected from the group consisting of alumina, silica-alumina, silica-magnesia, silica zirconia, silica thoria, silica-beryllia and silica titania.

In a further embodiment of the present application, the micro-spherical solid fluidizable catalyst composition comprises 0 to 2 wt % of the non-crystalline acidic material.

In further more embodiment of the present application, the micro-spherical solid fluidizable catalyst composition comprises 70 to 80 wt % of the binder.

In another embodiment of the present application, prior to contacting the micro-spherical solid fluidizable catalyst composition with the hydrocarbon feed stream, the micro-spherical solid fluidizable catalyst composition is activated by treating the same with saturated steam under a temperature of about 550° C. for a time period of about 3 hour.

In yet another embodiment of the present application, wherein in step (a), the ratio of the activated micro-spherical solid fluidizable catalyst composition to hydrocarbon feed stream is in the range of 2 to 10 wt/wt.

In still another embodiment of the present application, the hydrocarbon feed stream has 95% true boiling point less than about 250° C.

In one more embodiment of the present application, the hydrocarbon feed stream comprises straight run or cracked components produced by catalytic processes such as hydro-possessing, FCC or thermal cracking processes like coking and visbreaking, and or mixture thereof In one another embodiment of the present application, wherein subsequent to step (b), the process further comprises:

(c) separating the spent catalyst from the hydrocarbon product vapors thus formed at a top portion of the dense bed reactor;

(d) passing the spent catalyst from the reactor into a catalyst stripper where the catalyst is stripped to remove entrained hydrocarbons using steam, and (e) burning the stripped catalyst of step (d) in a turbulent or fast fluidized bed regenerator in presence of air and/or oxygen containing gases at a temperature in the range of 600 to 700° C. to burn off coke and provide a regenerated catalyst with coke content less than 0.05 wt % at the bottom of the riser, which is re-circulated to the riser.

In one further embodiment of the present application, the catalyst is continuously circulated between the fluidized bed regenerator, riser, dense bed reactor and stripper via standpipe and slide valves.

In another embodiment of the present application, the yield of gasoline is in the range of 30 to 50% (wt/wt).

In yet another embodiment of the present application, the sulfur content in the product gasoline is also reduced by about 90 to 95% wt/wt to that of the hydrocarbon feed.

In still another embodiment of the present application, the olefin content of the gasoline is less than or equal to 2 wt % irrespective of the feed olefin content and type of olefins in the feed.

In a further embodiment of the present application, the ratio of ethane to ethane plus ethylene expressed in wt/wt in product is in the range of 0.65 to 0.80.

In conformity of the present invention, hydrocarbon streams with 95% true boiling point less than 400° C., and preferably below 250° C. is converted to very high yield of LPG containing more than 80% saturates and high octane gasoline with substantially lower olefin and sulfur content. The gasoline produced in this process is mostly olefin free (<2 wt %) irrespective of the olefin content of the feedstock.

In accordance with the present invention, the hot regenerated catalyst is injected at the bottom of a high velocity up-flow riser wherein the hydrocarbon feed is injected through a nozzle along with dispersion and atomization gas. The velocity in the riser is maintained at a sufficiently high value so that there is little or no slippage between the hydrocarbon and catalyst flowing through the riser. The primary purpose of providing the riser is to achieve proper mixing of the feed hydrocarbons and the regenerated catalyst. The said riser is terminated into a large inventory of catalyst operating in bubbling bed or preferably dense bed with WHSV in the range of 0.1-20 $hr^{-1}$ at temperature in the range of 400-550° C. The overhead pressure on the dense bed catalyst inventory is maintained in the range of 2-20 $kg/cm^2$ (g). The hydrocarbon product effluent passes through a conventional cyclone system to separate the catalyst fines contained therein and is discharged to a fractionator. The hydrocarbons separated from the catalyst are primarily lighter gaseous components ($C_1$ to $C_4$ hydrocarbons) and gasoline.

The carbonized spent catalyst is transported to a separate vessel acting as stripper by maintaining a particular level in the dense bed reactor. Steam is introduced into the catalyst stripper to remove any entrained hydrocarbons in the catalyst. Stripped hydrocarbons along with associated steam enter into the reactor top for recovery of hydrocarbons.

The stripped catalyst is passed through a lift line to a dense or turbulent fluidized bed regenerator when the coke on catalyst is burnt in presence of commercial Carbon monoxide (CO) combustion promoter by air and or oxygen containing gases to achieve coke on regenerated catalyst (CRC) lower than 0.05 wt %. Air and or oxygen containing gases is also used as media to lift the catalyst into the regenerator for achieving partial burning of coke in the lift line itself. Regenerated catalyst is circulated back to the bottom of the riser.

In the present invention, the delta coke (defined as the difference in CSC- wt % of coke on spent catalyst and CRC) is low due to lower coke make in the cracking reactions, which is expected to keep the regenerator temperature at relatively lower level as compared to the conventional FCC operation. However, lower catalyst to oil ratio is likely to compensate this effect and thereby maintain the regenerator temperature at least to the same level as required for burning of coke on catalyst in presence of CO combustion promoter. Flue gas leaving the regenerator catalyst bed is passed through cyclones system for the separation of catalyst fines and then discharged for pressure reduction and energy recovery before venting through stack.

Besides the heat provided by the hot regenerated catalyst, external heat is supplied into the riser through higher feed preheat temperature to achieve the desired temperature in the rise and the dense bed reactor, which is preferably above 400° C. With a given feed preheat temperature; the temperature at the top of the riser is controlled by the catalyst flux into the riser.

Further details of feedstock, catalyst and products of the process of the present invention are described below:

Feedstock

Feedstock for the present invention includes hydrocarbon fractions having 95% true boiling point less than 400° C. The fractions could be straight run or cracked components produced by catalytic processes, as for example, hydroprocessing, FCC or thermal cracking processes like cooking, visbreaking, etc. and or mixture thereof. The conditions in the process of the present invention are adjusted depending on the type of the feedstock to maximize the yield of LPG. The LPG yield, gasoline RON, aromatics yield and extent of desulfurization, etc. are maximized if 95% true boiling point is lower than 250° C. Details of the feedstock properties are outlined in the examples given in the subsequent section of the patent. The above feedstock types are for illustration only and the invention is not limited in any manner to only these feedstocks.

The following nomenclatures are generally applicable in all the examples cited here.

| | |
|---|---|
| SRN | Straight run naphtha |
| LCO | Light Cycle oil |
| CN | Coker naphtha |
| FCCN | FCC gasoline |

-continued

| | |
|---|---|
| MSN | Mixed naphtha predominantly containing SRN |
| MCN | Mixed naphtha containing 50 wt % CN |
| MCFN | 90 wt % MCN + 10 wt % FCC gasoline |

Catalyst

Catalyst employed in the process of the present invention predominantly consists of pentasil shape selective zeolites. Other active ingredients, as for example, Y zeolite in rare earth and ultra stable form, non-crystalline acidic materials or combinations thereof are also added to the catalyst formulation to a limited extent for producing synergistic effect towards maximum LPG production. It may be noted that conventional FCC catalyst mainly consists of Y zeolite in different forms as active ingredient to accomplish catalytic cracking reactions. Ranges as well as typical catalyst composition for the process of the present invention and FCC process are summarized in Table-1 on weight percentage.

TABLE 1

Catalyst composition of the present invention and conventional FCC

| | Process of the present invention | | Conventional FCC | |
|---|---|---|---|---|
| Components | Range | Preferred range | Range | Typical |
| Shape selective pentasil zeolite | 10-40 | 15-30 | 0-3.0 | 1.0 |
| ReY/USY-zeolite | 0-10 | 0-5 | 8-25 | 15.0 |
| Non-crystalline acidic material | 0-5 | 0-2 | — | — |
| Non-acidic components & binder | 60-85 | 70-80 | 70-91 | 80.2 |

From the Table-1, it is seen that the catalyst composition in the process of the present invention is markedly different in terms of pentasil zeolite and Y-zeolite content as compared to FCC catalyst. Examples of non-crystalline acid materials are, alumina, silica-alumina, silica-magnesia, silica-zirconia, silica-thoria, silica-beryllia, silica-titania. Non-crystalline materials contain about 10 to 40 wt. % alumina and rest is silica with or without other promoters. Examples of rare earth components are lanthanum and cerium in oxide form.

The pore size range of the active components namely, pentasil and Re-USY zeolite are in the range of 0.5-0.6 and 0.8-1.1 nanometers respectively. The active components in the catalyst of the process of the present invention, as for example, pentasil zeolite, Y zeolite, etc. are supported on inactive materials of silica/alumina/silica alumina compounds including kaolinites. The active components could be all mixed together before spray drying or separately bound, supported and spray dried using conventional state of the art spray drying technique and conditions used to produce FCC catalyst micro-spheres. These spray-dried micro-spheres are then washed, rare earth exchanged and flash dried following conventional methods to produce the finished catalyst particles. The finished micro-spheres containing active materials in separate particles are physically blended in desired proportion to obtain a particular catalyst composition.

The typical physico-chemical properties of the finished micro-spheres containing active materials such as pentasil zeolite and Y-zeolite are given in Table-2 & 3 respectively.

TABLE 2

Physico-chemical properties of the pentasil zeolite based catalyst

| | | |
|---|---|---|
| Surface area, $m^2/gm$ | Fresh | 65-80 |
| | Steamed | 75-90 |
| Crystallinity, wt % | Fresh | 14-20 |
| | Steamed | 12.-18 |
| Pore volume, cc/gm | | 0.30-0.40 |
| Chemical Analysis, wt % | | |
| $Al_2O_3$ | | 25-35 |
| Na2O | | 0.35-0.45 |
| Fe | | 0.4-0.6 |

TABLE 3

Physico-chemical properties of the Y-zeolite based catalyst

| | | |
|---|---|---|
| Surface area, $m^2/g$ | Fresh | 110-180 |
| | steamed | 100-140 |
| % Crystallnity | Fresh | 10-15 |
| | Steamed | 8-12 |
| Unit Cell Size, oA | Fresh | 24.35-24.75 |
| | Steamed | 24.2-24.6 |
| Micro-pore area, $m^2/g$ | Fresh | 65-100 |
| | Steamed | 60-90 |
| Meso-pore area, $m^2/g$ | Fresh | 45-80 |
| | Steamed | 40-50 |
| Pore volume, cc/gm | | 0.25-0.38 |

The preferred range of major physical properties of the finished fresh catalyst which are required for the process of the present invention are summarized below:

Particle size range, micron: 20-130

Particle below 40 microns, wt %: <20

Average particle size, micron: 60-100

Average bulk density, micron: 0.6-1.0

Typically, the above properties and other related physical properties, e.g., attrition resistance, fluidizability etc. are in the same range as used in the conventional FCC process. Although pentasil zeolite materials such as zeolite ZSM-5, ZSM-11 have been published as hydrocarbon cracking catalyst, the present invention is directed to specific use of pentasil zeolite catalyst system for selectively cracking naphtha to produce light saturates.

Products

The main product in the process of the present invention is LPG comprising $C_3$ and $C_4$ hydrocarbons, which is obtained with yield in the range of 45 to 65 wt % of feed. The other important product is aromatic rich high-octane gasoline, which is almost olefin free. A very small part of the feed is converted to coke and deposited on the circulating catalyst system. The coke on catalyst is burnt in the regenerator and the exothermic heat thus produced is utilized in the reactor. The typical range of the products obtained from the process of the invention is given in Table-5.

TABLE 5

Typical product yields obtained by the process of the present invention

| PRODUCT | Yield, wt % of feed |
|---|---|
| Dry Gas ($H_2 + C_1 + C_2$) | 1-10 |
| LPG ($C_3 + C_4$) | 45-65 |
| Gasoline ($C_5$ – 200° C.) | 20-40 |
| Coke | 0.5-2.2 |

By changing the process conditions and design of catalyst, it is quite possible to alter the gas to liquid product ratio to a significant extent.

The LPG produced from the process of the invention is highly saturated with olefins less than 20 wt %. The propane and butane percentages in corresponding $C_3$ and $C_4$ fractions are more than 80 and 75 (w/wt) respectively. Typical LPG composition in the process of the present invention is given below.

TABLE 6

Typical composition of LPG obtained by the process of the present invention

| Components | Composition (wt % of LPG) |
|---|---|
| Propane | 56-69 |
| Propylene | 5-6 |
| Total $C_3$ | 61-74 |
| Isobutane | 11.5-14.5 |
| n-Butane | 11.5-14.5 |
| Isobutylene | 1-3 |
| 1-Butene | 0.4-0.8 |
| t-2-Butene | 1.25-2 |
| cis-2-Butene | 0.75-1.5 |
| Total $C_4$ saturates | 23-29 |
| Total $C_4$ | 26-39 |

This shows that the LPG from the process of the present invention is highly saturated and therefore suitable for its use as automotive fuel.

The dry gas is also highly saturated with 70 wt % of ethane in $C_2$ fraction. Typical dry gas composition in the process of the present invention is given below.

TABLE 7

Typical composition of dry gas obtained by the process of the present invention

| Components | Composition (wt % of dry gas) |
|---|---|
| Hydrogen | 19.1-21.5 |
| Ethane | 58-62 |
| Ethylene | 22.9-16.5 |
| Ethane/total $C_2$ | 69-78 |
| Ethane/dry gas | 55-62 |

One of the important aspects of our invention is that olefin can be directly converted to the product in the reactor itself unlike conventional reforming process where olefins are totally saturated in a separate reactor before entering into the reforming reactor. The catalyst and the contacting system in the present invention are capable to handle as much olefins in the feed, without adding any external hydrogen. The gasoline produced in this process is mostly olefin free irrespective of the olefin content of the feedstock.

The other important benefit of the invention is its flexibility to produce gasoline with high octane rating but with significantly lower olefin content as compared to the conventional FCC gasoline. Aromatics such as toluene, xylenes, etc. are maximized in the process. Table-8 shown below compares the typical distribution of saturates, olefins and aromatics along with benzene, toluene, xylene and ethyl benzene of the liquid products of the present invention with that of FCC gasoline and reformate.

TABLE 8

Comparison of properties of liquid products of different processes

| Feed Wt % | Liquid Product of present invention | FCC gasoline | Reformate |
|---|---|---|---|
| Saturates | 24-47 | 35-20 | 30-25 |
| Olefins | 1.2-2.2 | 50-55 | Nil |
| Aromatics | 51-74 | 15-25 | 70-75 |
| Benzene | 4.5-7.0 | 0.5-0.6 | 0.2-0.5 |
| Toluene | 18.-24 | 3.0-5.0 | 25-30 |
| Ethyl benzene | 2.0-3.8 | 0.5-1.0 | 5.0 |
| m-p Xylene | 9.0-16 | 2.5-3.5 | 25.0 |
| o-Xylene | 2.5-5.0 | 0.5-1.0 | 3.0 |
| RON | 92-98 | 90-95 | >98 |

The benzene in gasoline produced from the process of the invention can be maintained less than 0.5 wt % by splitting the benzene rich light cut. The light cut can be routed to ethylene cracker after extracting benzene or to naphtha isomerization unit. The typical properties of the benzene rich light cut and lean cut after splitting the liquid product of the process of the present invention are given below in table 9.

TABLE 9

Properties of benzene rich light & benzene lean cuts

| PROPERTY | Benzene rich cut | Benzene lean cut |
|---|---|---|
| Benzene, wt % | 38.8 | 0.5 |
| Aromatics, wt % | 38.8 | 58.4 |
| Olefins, wt % | 10.4 | <0.5 |
| RON | 85 | 93 |

Therefore, the benzene lean cut of the liquid product obtained from the process of the present invention can be directly blended into refinery gasoline pool without requiring any additional pre-treatment.

Unlike conventional FCC process, the process of the present invention desulfurises the liquid products more than 90 wt % without requiring any external hydrogen. The distribution of the sulfur in liquid product of the process of the present invention is compared with that of the feed in table 10 given below. The total sulfur content of the liquid product is less than 5 wt % of sulfur in the feed.

TABLE 10

Distribution of sulfur in liquid product

| | Feed | | Liquid product | |
|---|---|---|---|---|
| | Mercaptans | Thiophenic | Mercaptans | Thiophenic |
| | Sulfur compounds, ppm | | | |
| High sulfur olefin rich naphtha | 183 | 734 | 14 | 41 |
| Low sulfur paraffin rich naphtha | 48 | 192 | 12 | 38 |

Thus the sulfur content of the liquid product of the process of the present invention is also substantially lower, thereby allowing the direct into gasoline pool directly after extracting the benzene.

The following examples will demonstrate flexibility of the present invention towards various feedstocks and the quantum of LPG yield that can be produced from this process along with other associated advantages. These examples are to be considered illustrative only and are not to be considered as limiting the scope of the present invention.

EXAMPLE 1

High Yield of LPG

This example illustrates the important features of the process of the present invention to produce very high LPG yield from various naphtha range feedstocks. Catalyst used in this example is medium pores pentasil zeolite and Re-USY zeolite based having properties as shown in the Table-2 & 3. Initially, experiments were conducted in a circulating fluidized bed riser pilot plant of 1.5 kg/hr feed capacity under very high reaction severity. The crackability of naphtha range feedstock as well as the LPG selectivity under conventional circulating fluidized bed riser conditions was found to be not much attractive.

We have discovered that in distinction to prior art processes for production of light olefins and/or high octane gasoline using naphtha range hydrocarbon feeds, completely different reaction conditions are needed for maximized production of LPG comprising predominantly saturated alkanes. We have found that higher residence time of hydrocarbon vapors above 5 seconds is essential for converting the naphtha range hydrocarbons to saturated light paraffins. The higher residence time of hydrocarbons is achieved by providing a dense bed reactor with very low WHSV. Higher reactor pressure than that of conventional circulating fluidized bed catalytic processes commonly under practice is found to favor the higher conversion of naphtha towards LPG. In distinction to prior art processes for conversion of naphtha range hydrocarbon feeds, a lower temperature is desirable to attain the objectives of the invention as outlined above.

In accordance with the present invention, a dense bed reactor with WHSV in the range of 0.1-20 $hr^{-1}$ with higher contact time between feed and catalyst under higher pressure in the range of 2-20 kg/cm2 (g) and relatively lower temperature in the range of 400-550° C. is provided to obtain very high yield of LPG. The comparison of product yields and operating conditions of conventional riser system with higher reaction severity and the present process of invention using similar feedstock is presented in Table-11.

TABLE 11

Comparison of conventional riser reactor with dense bed reactor of present invention

| | Riser pilot plant | Dense bed reactor |
|---|---|---|
| Feed | SRN | SRN |
| Temperature, ° C. | 570 | 480 |
| Pressure, $kg/cm^2$ (g) | 1 | 5 |
| Catalyst/Oil ratio (wt/wt) | 23 | 4.4 |
| WHSV, $hour^{-1}$ | 150 | 1.5 |
| Hydrocarbon residence time, sec. | <1 | >5 |
| Products (Wt % fresh feed) | | |
| Dry gas ($C_3$-) | 1.31 | 7.84 |
| LPG ($C_3 + C_4$) | 14.48 | 44.64 |
| Coke | 0.1 | 1.01 |

It is seen from the Table-11, although high temperature and high catalyst to oil ratio were maintained in riser reactor, the SRN feed could not be cracked much. The severity of the reaction in terms of temperature, catalyst to oil ratio, WHSV and pressure was entirely different in case of dense bed reactor. The reaction severity in terms of WHSV and pressure are more dominating and responsible for high yield of LPG in dense bed reactor. Therefore, the process of the present invention is distinct in application of combination of reaction severity parameters to obtain very high LPG yield in the range of 45-65 wt % of feed comprising more than 80% of $C_3$ and $C_4$ alkanes.

EXAMPLE-2

Catalyst Composition

This example illustrates the importance of catalyst composition in obtaining maximized yield of LPG. Numerous experiments were conducted with different catalyst compositions having composition given in table 12 using MCN feed in a stationery dense fluidized bed reactor unit of 200 gm catalyst inventory operated in batch mode for reaction, stripping and regeneration. The reactor pressure could be maintained up to 50 bar using a pressure control valve. All catalyst systems mentioned below are steamed at 550° C. for 3 hours in presence of 100% steam before using in experiments.

TABLE 12

Catalyst systems of different composition

| | Catalyst system | | |
|---|---|---|---|
| | Cat-1 | Cat-2 | Cat-3 |
| Shape selective pentasil zeolite | 22.5 | 5.4 | 30 |
| Re-USY-zeolite | 2.5 | 19 | 5 |
| Non-crystalline acidic components | 1 | 1 | 1 |
| Non-acidic components & binder | 74 | 74.6 | 64 |

TABLE 13

Operating conditions

| | | |
|---|---|---|
| Temperature | ° C. | 480 |
| Pressure | $kg/cm^2$ (g) | 6 |
| WHSV | Hour-1 | 1.5 |
| Residence time of catalyst in the reactor | Minutes | 10 |
| Residence time of Hydrocarbons in the reactor | Seconds | 15 |

Similar operating conditions as summarized in Table-13 were maintained for all catalyst systems mentioned above in table 12. The yields of LPG, dry gas and coke obtained with these catalyst systems is given here below in the form of table 14:

TABLE 14

Catalyst systems of different composition

| | Catalyst system | | |
|---|---|---|---|
| Yields, wt % | Cat-1 | Cat-2 | Cat-3 |
| Dry gas | 7.84 | 4.8 | 12.0 |
| LPG | 46.5 | 25.0 | 41.3 |
| Coke | 0.5 | 2.1 | 1.4 |

It is seen in above Table-14, LPG yield is lowest for Cat-2, which is having minimum concentration of shape selective pentasil component. Increasing the concentration of shape selective pentasil component is promoting dry gas formation. However, excessive presence of shape selective pentasil component decreases the dry gas formation. Also, it can be seen that minimum or excessive presence of shape selective pentasil component increases the amount of coke being formed.

In view of the above, it is also very important to control the amount of the shape selective pentasil component added to the catalyst composition. This example demonstrated that there is an optimum catalyst composition, which gives maximum LPG yield with moderate coke and dry gas yield.

EXAMPLE-3

Optimum Operating Parameters

This example demonstrates that selection of the operating conditions is very important for producing maximum LPG and minimum dry gas and coke. The effects of operating conditions, particularly, vapor residence time, temperature, pressure, WHSV on product yield pattern were tested with particular catalyst having similar composition to Cat-1 using SRN as feedstock. The results are summarized below in table 15.

TABLE 15

| Vapor residence time, seconds | 5 | 7 | 10 | 5 |
|---|---|---|---|---|
| Temperature, ° C. | 480 | 480 | 480 | 520 |
| | Yields, wt % | | | |
| Dry gas | 6.82 | 7.02 | 7.15 | 9.0 |
| LPG | 42.2 | 46.5 | 42.6 | 39.9 |
| Coke | 1.5 | 1.7 | 2.57 | 3.50 |

WHSV was kept constant in the above runs. Vapor residence time was varied by changing the reactor pressure. It is seen that LPG yield increases from 42.2 to 46.5 wt % with increase in residence time from 5 to 7 seconds. When residence time is increased further to 10 seconds, LPG yield reduces whereas with significant increase in coke yield. The yield of dry gas also increases marginally. Even at residence time of 5 seconds, with increase in temperature to 520° C. from 480° C., LPG yield decreases with simultaneous increase in both dry gas and coke.

We have found that for all the process parameters, there exists an optimum, which vary depending on the hydrocarbon composition in feed and the catalysts system applied. The Applicants have surprisingly found that in direct contradiction to the prior art process for production of light olefins and/or high-octane gasoline using naphtha range hydrocarbon feeds, lower temperature and higher pressure are desirable in the present invention to attain the objectives of higher LPG yield and higher octane of gasoline product.

EXAMPLE-4

Processing of Different Types of Naphtha

This example illustrates the capability of the process of the present invention to process various naphtha range feedstocks containing different quantity of olefins as well as sulfur. A series of experiments were conducted using different hydrocarbon streams namely SRN, CN, FCCN and mixture of these streams. The physico-chemical properties of the feeds used are summarized in Table-16.

The yields of LPG and dry gas with different feed streams are shown in Table-17. It is seen from Table-16 that the LPG produced is in the range of 45-67 wt %. Process is able to handle all types of naphtha available in an operating refinery to convert it to very high yield of LPG. Also, the LPG yield increases with increase in olefins content in feed.

TABLE 16

Properties of naphtha feed stocks

| | Feed | | | | |
|---|---|---|---|---|---|
| Products, wt % of feed | SRN | MSN | MCN | MCFN | CN |
| Dry gas ($H_2$, $C_1$ & $C_2$) | 7.84 | 8.43 | 8.39 | 10.29 | 9.91 |
| LPG ($C_3 + C_4$) | 45.64 | 49.11 | 50.15 | 56.71 | 67.12 |
| Coke yield | 0.50 | 0.75 | 0.80 | 1.20 | 1.7 |

Average boiling point, ° C. = (10% + 2 * 50% + 90%)/4

TABLE 17

Typical product yields of different feedstocks

| | Feed | | | | |
|---|---|---|---|---|---|
| | SRN | MSN | MCN | MCFN | CN |
| Density, gm/cc@15° C. | 0.74 | 0.7326 | 0.7295 | 0.73 | 0.72 |
| Sulfur, ppm | 18 | 240 | 917 | — | 1600 |
| Saturates | 85.0 | 86.0 | 64.4 | 58.4 | 41.3 |
| Olefins | Nil | 1.3 | 23.6 | 29.9 | 49.4 |
| Aromatics | 15.0 | 12.7 | 12 | 11.7 | 9.3 |
| RON | 85.4 | 66.1 | 69.5 | 88.5 | 74 |
| Average boiling point, ° C. | 101.6 | 116.5 | 109.3 | 111 | 78.5 |

EXAMPLE-5

Liquid Product Composition and Quality

This example illustrates the composition and quality of the liquid product obtained in the process of the present invention. The distribution of hydrocarbon types, i.e., olefins, aromatics and saturates in the liquid product obtained from different type feeds are given below in Table-18:

TABLE 18

Saturates/olefins/aromatics distribution in liquid products

| Wt % in | Feed | | | | |
|---|---|---|---|---|---|
| liquid product | SRN | MSN | MCN | MCFN | CN |
| Saturates | 47.0 | 44.1 | 36.2 | 28.7 | 24.2 |
| Olefins | 2.2 | 1.3 | 2.5 | 2.1 | 2.2 |
| Aromatics | 50.8 | 54.6 | 61.3 | 69.2 | 73.6 |

On comparison with the feed composition as shown in Table-16 in Example-4, it is seen that above 95 wt % of the olefin reduction based on total olefin content in feed is achievable in the process. In context of requirement of gasoline specifications with respect to olefins content, this specific attribute of olefin reduction in the process of invention is a distinct advantage.

The aromatics content in the liquid product is more than 50 wt %. The distribution of benzene, toluene, xylene and ethyl benzene in the liquid products produced from different feedstocks are shown in Table-19.

TABLE 19

| Wt % in liquid product | Liquid product properties Feed SRN | MSN | MCN | FCCN | CN |
|---|---|---|---|---|---|
| Benzene | 7.01 | 5.68 | 6.31 | 7.46 | 4.51 |
| Toluene | 17.86 | 18.81 | 20.58 | 21.85 | 24.58 |
| Ethyl benzene | 2.06 | 2.91 | 2.87 | 3.02 | 3.69 |
| m-p Xylene | 9.16 | 12.10 | 12.46 | 15.28 | 15.91 |
| O-Xylene | 2.52 | 3.41 | 3.45 | 4.34 | 4.97 |

The toluene and xylene contents in the liquid products of the process of the invention are quite high, which can be recovered as aromatics for use as petrochemical feedstocks. The RON of the liquid products obtained from different feedstocks is compared with the RON of feed in Table-20. The minimum RON of the liquid product is obtained from SRN feed, which does not contain any olefins. As the feed olefin content increases, the RON increases. It is also seen that the RON of the liquid product was more than 92 irrespective of the nature of the feedstocks.

TABLE 20

| | Research Octane Number of liquid product Feed SRN | MSN | MCN | MCFN | CN |
|---|---|---|---|---|---|
| RON | 85.4 | 66.1 | 69.5 | 88.5 | 74 |
| RON | 92.5 | 92.9 | 94.9 | 96.8 | 97.4 |

EXAMPLE-6

Olefin and Sulfur Reduction in Liquid Product

This example illustrates the capability of the process of the invention to convert the sulfur in feed to hydrogen sulfide and thereby reduce the concentration of sulfur in the liquid product.

The sulfur distribution of feed and liquid product are obtained by GC-PFPD/sulfur analyzer. The sulfur distribution in products obtained from MSN and MCN feeds under the process conditions similar to that given in Table-13 is shown in Table-21.

TABLE 21

| Feed | Sulfur distribution in products MSN | MCN |
|---|---|---|
| Total sulfur in feed, ppm | 240 | 916 |
| Weight percent of feed sulfur | | |
| Dry gas | 70.36 | 72.76 |
| LPG | 17.62 | 18.48 |
| Liquid | 9.15 | 4.20 |
| Coke | 2.87 | 4.57 |

The total sulfur content of the feed in low sulfur naphtha (MSN) and high sulfur naphtha (MCN) were 240 ppm and 917 ppm respectively. About 80% of the feed sulfur content was in the form of thiophene and thiophene derivatives. The product of low sulfur naphtha (MSN) had a sulfur content of 55 ppm by weight only. In case of high sulfur naphtha feed (MCN), sulfur content in the product was 117 ppm. Total sulfur reduction in the liquid product in all the experiments was in the range of 90 to 95 wt %. Reported sulfur compounds in the liquid product contain about 25 wt % mercaptan compounds. Significant part of the feed sulfur is being converted to hydrogen sulfide, which can easily be removed from dry gas.

The Applicants respectfully submit that the process of the present invention should not be understood as mere optimization of the operating parameter of known processes. The Applicants would like to emphasize here that in addition to optimizing the operating parameters, the applicants have also found the ideal catalyst composition which would provide the necessary results. The Applicants have for the first time been able to arrive at a method which is applicable to al types of naphtha/light gas oils. Further, for the first time the Applicants have been able to arrive at a process that simultaneously converts all types of hydrocarbon feed streams having 95% true boiling point less than about 400° C. to LPG comprising C3 and C4 hydrocarbons in the range of 30 to 65 wt % of the fresh hydrocarbon in high yield and gasoline having octane number greater than about 90. Here the applicants would like to highlight that till date no body has been provide a process which can simultaneously produce LPG and gasoline in such high yield from even a single feed, leave alone from a variety of feed streams.

The Applicants would also like to emphasize here that the process of the present invention should be considered in its entirety. The various stages/steps of the process (along with their respective operating parameters) should not be split and compared on an individual basis with existing prior art documents. The Applicants have been able to arrive at the unexpected and improved results after much trial and error and it is not possible to theoretically predict that varying a particular parameter in the entire process will result in improved result. As can be seen from our earlier experiments, varying any individual parameter beyond a certain extent will only adversely affect the results and will not give any improved results.

ADVANTAGES OF THE PRESENT INVENTION

The important advantages of the process of the present invention are summarized below:

(i) Possessing of all types of naphtha/light gas oils is possible.
(ii) Process uses circulating fluidized dense bed reactor-regenerator with adequate flexibility of changing the LPG to gasoline ratio in the products.
(iii) Rector pressure is higher than the conventional FCC.
(iv) Temperature of the reactor is quite low.
(v) High yield of saturated LPG is produced.
(vi) Highly saturated dry gas is produced.
(vii) High-octane gasoline product with substantially lower olefin content.
(viii) In-situ desulfurisation resulting less than 5% of feed sulfur in gasoline product.
(ix) Low yield of coke and lower regenerator temperature.

We claim:

1. A process for catalytic conversion of hydrocarbon feed stream having 95% true boiling point less than about 400° C. to LPG in the range of 30 to 65 wt % of the hydrocarbon feed stream, the said LPG comprising C3 and C4 hydrocarbons, and gasoline having octane number greater than about 92, said process comprising:

(a) contacting in a riser the hydrocarbon feed stream with hot activated micro-spherical solid fluidizable catalyst composition consisting of 5 to 40 wt % of medium pore crystalline alumino-silicate, 0 to 10 wt % of "Y" type zeolite, 0 to 5 wt % of non crystalline acidic material and the remaining being non-acidic component and binder; and (b) transporting the mixture of hydrocarbon feed stream and the catalyst into a dense bed reactor operating with weight hourly space velocity (WHSV) in the range of 0.1 to 20 $hr^{-1}$, hydrocarbon feed stream residence time being greater than 5 seconds and catalyst residence time being greater than or equal to 60 seconds for cracking the hydrocarbon feed stream at a temperature in the range of 400 to 500° C. and pressure in the range of 2 to 20 $kg/cm^2$ (g) thereby obtaining LPG comprising C3 and C4 hydrocarbons with olefin content less than 20% (wt/wt) and propane to butane ratio of more than 2 (wt/wt) and having propane in the range of 50 to 70%;

wherein the hydrocarbon feed stream is substantially devoid of hydrocarbons having less than or equal to 4 carbon atoms and comprises straight run naphtha (SRN), light cycle oil (LCO), coker naphtha (CN), FCC gasoline (FCCN), mixed naphtha predominantly containing straight run naphtha (MSN), mixed naphtha containing 50 wt % coker naphtha CN, a feed stream comprising 90 wt % of MCN and 10 wt % FCCN or mixtures of two or more thereof.

2. A process as claimed in claim 1, wherein the medium pore crystalline alumino silicates used comprises shape selective pentasil zeolite such as ZSM-5, ZSM-11 with pore diameter in the range of 0.5 to 0.6 nanometers.

3. A process as claimed in claim 2, wherein the micro-spherical solid fluidizable catalyst comprises 10 to 30 wt % of the shape selective pentasil zeolite.

4. A process as claimed in claim 1, wherein the "Y" type zeolite used is selected from ReY Or USY zeolite.

5. A process as claimed in claim 4, wherein the micro-spherical solid fluidizable catalyst composition comprises 0 to 5 wt % of ReY or USY zeolite.

6. A process as claimed in claim 1, wherein the non-crystalline acidic material is selected from the group consisting of alumina, silica-alumina, silica-magnesia, silica-zirconia, silica thoria, silica-beryllia and silica titania.

7. A process as claimed in claim 1, wherein the micro-spherical solid fluidizable catalyst composition comprises 0 to 2 wt % of the non-crystalline acidic material.

8. A process as claimed in claim 1, wherein the micro-spherical solid fluidizable catalyst composition comprises 70 to 80 wt % of the binder.

9. A process as claimed in claim 1, wherein prior to contacting the micro-spherical solid fluidizable catalyst composition with the hydrocarbon feed stream, the micro-spherical solid fluidizable catalyst composition is activated by treating the same with saturated steam under a temperature of about 550° C. for a time period of about 3 hour.

10. A process as claimed in claim 1 wherein in step (a), the ratio of the activated micro-spherical solid fluidizable catalyst composition to hydrocarbon feed stream is in the range of 2 to 10 wt/wt.

11. A process as claimed in claim 1, wherein the hydrocarbon feed stream has 95% true boiling point less than about 250° C.

12. A process as claimed in claim 1, wherein the hydrocarbon feed stream comprises straight run or cracked components produced by catalytic processes such as hydropossessing, FCC or thermal cracking processes like coking and visbreaking, and or mixture thereof.

13. A process as claimed in claim 1 wherein subsequent to step (b), the process further comprises:

(c) separating the spent catalyst from the hydrocarbon product vapors thus formed at a top portion of the dense bed reactor;

(d) passing the spent catalyst from the reactor into a catalyst stripper where the catalyst is stripped to remove entrained hydrocarbons using steam, and (e) burning the stripped catalyst of step (d) in a turbulent or fast fluidized bed regenerator in presence of air and/or oxygen containing gases at a temperature in the range of 600 to 700° C. to burn off coke and provide a regenerated catalyst with coke content less than 0.05 wt % at the bottom of the riser.

14. A process as claimed in claim 1, wherein the catalyst is continuously circulated between the fluidized bed regenerator, riser, dense bed reactor and stripper via standpipe and slide valves.

15. A process as claimed in claim 1, wherein the yield of gasoline is in the range of 30 to 50% (wt/wt).

16. A process as claimed in claim 1, wherein sulfur content in the product gasoline is also reduced by about 90 to 95% wt/wt to that of the hydrocarbon feed.

17. A process as claimed in claim 1, wherein the olefin content of the gasoline is less than or equal to 2 wt % irrespective of the feed olefin content and type of olefins in the feed.

18. A process as claimed in claim 1, wherein the ratio of ethane to ethane plus ethylene expressed in wt/wt in product is in the range of 0.65 to 0.80.

19. A process as claimed in claim 1, wherein the process is a continuous process, and wherein catalyst is continuously circulating through a riser, the dense bed reactor, a stripper and a regenerator.

* * * * *